US012618018B1

(12) United States Patent
Merritt et al.

(10) Patent No.: US 12,618,018 B1
(45) Date of Patent: May 5, 2026

(54) LIQUID BINDER FOR METALLURGIC AND STEEL MANUFACTURING AND METHOD OF BRIQUETTE FORMATION

(71) Applicant: NORTH AMERICAN METALLURGIC SOLUTIONS, LLC, St. Johns, FL (US)

(72) Inventors: Kevin Merritt, St. Johns, FL (US); James Gardner, East Northport, NY (US)

(73) Assignee: NORTH AMERICAN METALLURGIC SOLUTIONS, LLC, St John's, FL (US)

( * ) Notice: Subject to any disclaimer, the term of this patent is extended or adjusted under 35 U.S.C. 154(b) by 0 days.

(21) Appl. No.: 18/440,391

(22) Filed: Feb. 13, 2024

Related U.S. Application Data

(60) Provisional application No. 63/484,848, filed on Feb. 14, 2023.

(51) Int. Cl.
*C10L 5/14* (2006.01)
*C10L 5/36* (2006.01)
*C22B 1/244* (2006.01)

(52) U.S. Cl.
CPC ..... *C10L 5/14* (2013.01); *C10L 5/361* (2013.01); *C22B 1/244* (2013.01); *C10L 2250/02* (2013.01)

(58) Field of Classification Search
CPC ..... C10L 5/14; C10L 5/361; C10L 2250/02
See application file for complete search history.

(56) References Cited

U.S. PATENT DOCUMENTS

2007/0102115 A1* 5/2007 Falke ..... D06M 15/693 152/565
2024/0093328 A1 3/2024 Joyce et al.

FOREIGN PATENT DOCUMENTS

CN 109576489 A * 4/2019 ..... C21B 5/00
WO WO-2019034859 A1 * 2/2019
WO WO-2022200770 A1 * 9/2022 ..... C21B 13/0066

OTHER PUBLICATIONS

English-language machine translation of CN 109576489 A (Year: 2019).*

* cited by examiner

*Primary Examiner* — James C Goloboy
(74) *Attorney, Agent, or Firm* — Hovey Williams LLP; Paul J. Walker

(57) ABSTRACT

A briquette and binder for use in making the same are disclosed. The briquette including: a ferrous or ferro-alloy steel by-product; a binder mixture making up about 0.025% to about 10% of a batch weight, the binder mixture including: a polyvinyl alcohol resin comprising about 0.025% to about 30% of the binder mixture; a sodium hydroxide and diethanolamine phenolic resin comprising about 1% to about 20% of the binder mixture; and water making up the remainder of the binder mixture; a resin powder comprising about 0.01% to about 10% of the batch weight; and where the briquette, when cured, includes about 0.05% to about 10% of the binder mixture.

13 Claims, 3 Drawing Sheets

LIQUID BINDER FOR METALLURGIC AND STEEL MANUFACTURING AND METHOD OF BRIQUETTE FORMATION

RELATED APPLICATION

This application claims priority to U.S. Provisional Patent Application No. 63/484,848, filed Feb. 14, 2023, which is incorporated herein by reference in its entirety.

BACKGROUND

Iron is, by mass, the most common element on Earth, forming much of Earth's inner and outer core. Iron alloys, such as steel, stainless steel, cast iron and specialty steel, are the most common industrial metals, due to their mechanical properties and low cost. Accordingly, the iron and steel industry is very important economically. In particular, steel accounts for approximately 93% of the annual metal production in the world.

Approximately 57% of raw steel is produced through a process using blast furnaces and the remaining, approximately 43%, of raw steel is produced through electric arc furnace (EAF) from scrap metal. Regardless of how it is produced, steel production has a waste stream and various waste by-products. In some instances, steel production includes solid wastes that are generated during the processing and production of iron and steel. Other waste by-products of steel production may include slag, dust, fines, and sludge generated by steel plants. Most of the waste is conventionally transported to, and buried in, landfills or is alternatively processed into a metal briquette. These briquettes are typically not desirable for re-use in steel production or other processes as they have a high percentage of deleterious binders. Additionally, this waste by-products from steel production may cause environmental pollution and/or health issues when disposed of at a landfill.

Accordingly, there is a need in the art for the creation of binder and agglomeration process to eliminate impurities and deleterious materials such as, bentonite clay, sodium silicate, cement, and molasses in order to minimize the waste from steel production. These binders accumulate in the slag portion of the steel production process and can cause damage to the furnace. There is a need in the art to preserve, and not impact, the mineral chemistry of the waste to produce a higher quality, more usable, briquette. There is a need in the art to increase the iron content throughput and reduce the percentage of impurities in processing of byproducts from the steel production process.

SUMMARY

The herein-described embodiments address these, and other problems associated with the art by providing a liquid binder for use in briquette. Therefore, consistent with one aspect of the invention, a briquette includes: a ferrous or ferro-alloy steel by-product; a binder mixture comprising about 0.025% to about 10% of a batch weight, the binder mixture including: a polyvinyl alcohol resin comprising about 0.025% to about 30% of the binder mixture; a sodium hydroxide and diethanolamine phenolic resin comprising about 1% to about 20% of the binder mixture; and water comprising a remainder of the binder mixture; a resin powder comprising about 0.01% to about 10% of the batch weight; and wherein the briquette, when cured, has comprising about 0.05% to about 10% of the binder mixture.

In some implementations, the resin powder is a powdered phenolic novolac with hexamethylenetetramine. In some implementations, the briquette further includes a dry cellulous matter comprising about 0.005% to about 5.0% of the batch weight.

In some implementations, the briquette has a Cold Crush Strength (CCS) of about 80 lbs to about 300 lbs. In some implementations, the briquette, when cured, has a cured crush strength of about 300 lbs to about 1,500 lbs. In some implementations, the briquette requires eight hours to cure; however, in some implementations, the briquette can be handled after one hour of cure time.

In some implementations, the binder mixture further includes a microbicidal comprising about 0.1% to about 5.0% of the binder mixture. In some implementations, the binder mixture further includes an ester based hardener comprising about 0.05% to about 5.0% of the binder mixture.

In another aspect, a binder for use in the formation of briquettes from ferrous or ferro-alloy steel by-products is disclosed, the binder including: a polyvinyl alcohol resin comprising about 0.025% to about 30% of the binder; a sodium hydroxide and diethanolamine phenolic resin comprising about 1.0% to about 20% of the binder; and water comprising a remainder of the binder.

In some implementations, the binder for use in the formation of briquettes from ferrous or ferro-alloy steel by-products further includes a microbicidal compound including about 0.1% to about 5.0% of the binder. In some implementations, the binder for use in the formation of briquettes from ferrous or ferro-alloy steel by-products further includes an ester based hardener system comprising about 0.05% to about 5.0% of the binder.

In further implementations, the binder is added to a ferrous or ferro-alloy steel by-product at about 0.025% to about 10% of a batch weight forming a briquette mixture. In some additional implementations, the briquette mixture further includes a dry cellulous matter comprising about 0.005% to about 5.0% of the batch weight. In further implementations, the briquette mixture further includes a resin powder comprising about 0.01% to about 10% of the batch weight. In some implementations, the resin powder is a powdered phenolic novolac with hexamethylenetetramine.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description and is not intended to identify key or essential features of the claimed subject matter, nor is it intended to be used as an aid in limiting the scope of the claimed subject matter.

DETAILED DESCRIPTION

Figure 1:
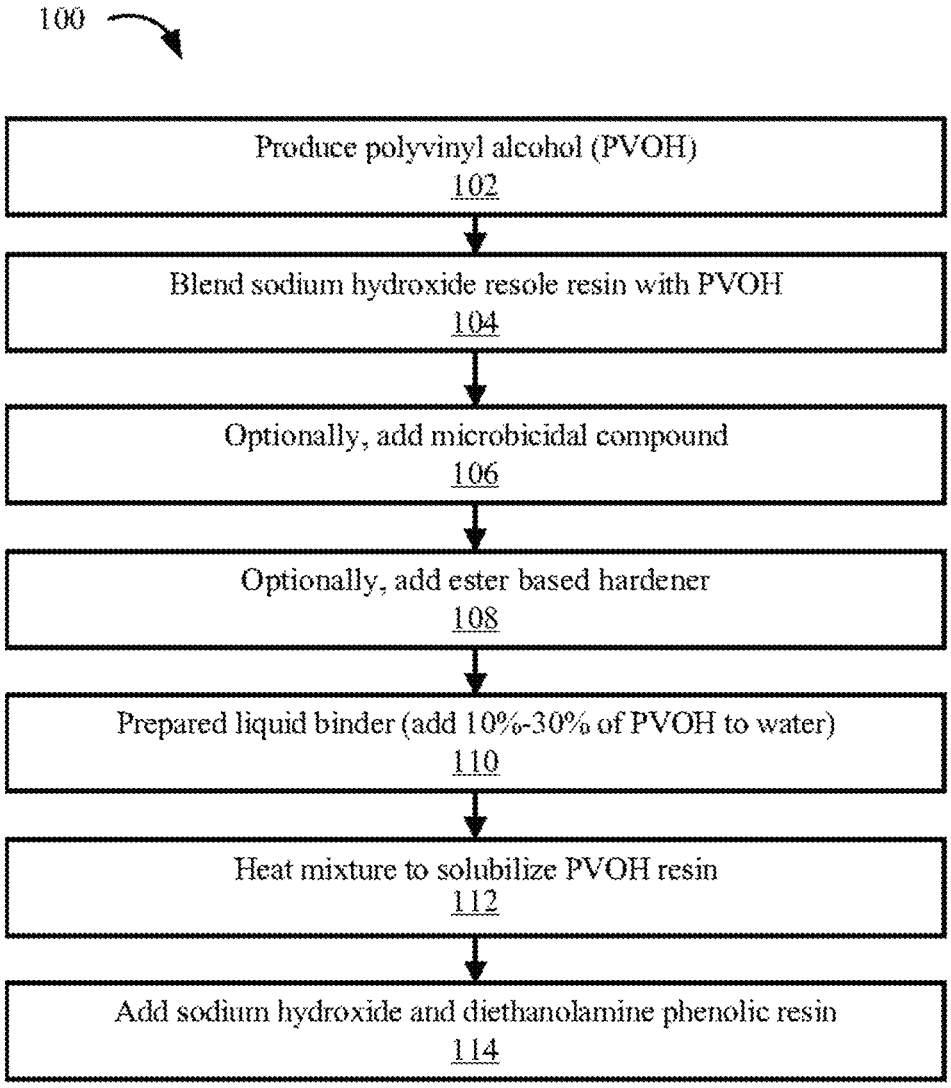
FIG. 1 is an operational flowchart of the production of a resin-polymer liquid binder consistent with some embodiments of the invention.

Numerous variations and modifications will be apparent to one of ordinary skill in the art, as will become apparent from the description below. Therefore, the invention is not limited to the specific implementations discussed herein.

A resin-polymer liquid binder described herein for use in briquette production of ferrous and/or ferro alloy steel by-products and waste streams from the metal manufacturing process. These by-products include, but are not limited to, fines, dust, bag house dust, sludge, spent shot, laser dust, mill scale, titanium fines, ferro molybdenum, nickel, chrome, and so on. The resin-polymer liquid binder described herein may be used produce a briquette resulting in a final binder content of about 0.05% to less than 10%. Conventionally, the process used to make metal by-product and waste stream briquettes has resulted in briquettes with a binder content of between about 10% to about 20% in the final briquette; furthermore, these conventional binders are typically comprised of molasses, cement, lime, sodium bentonite clay, and/or other deleterious materials that increase the slag generation of the steel making process.

The resin-polymer liquid binder described herein may improve the mineral chemistry and may provide for a higher value back to the steel process without the additional slag and undesirable material found in conventional binder making technology. These undesirable materials will accumulate in the slag portion of the steel making process. During the steel making process, the top layer may be referred to as the "slag" portion or layer, while the bottom layer may be referred to as the "tap" layer, which may be pure iron.

The agglomeration process using the resin-polymer liquid binder described herein, including the dry additives may produce a briquette with adequate green strength (e.g., about 80 psi to about 300 psi cold crush strength (CCS)). The "green" or cold crush strength (CCS) of a briquette represents the strength of the briquette in its unfired or partially cured state, more specifically it tells how much load the briquette may bear when discharged from the roller press. Additionally, the agglomeration process using the binder described herein may produce a briquette with an adequate cured crush strength (e.g., about 300 psi to about 1, 500 psi crushing strength). The cured crush strength (or simply crush strength) refers to the ability of a material (e.g., the cured briquette) to withstand compressive forces or pressure without breaking or deforming. The resulting briquettes may need to be handled in an industrial operation with equipment such as front-end loaders, magnetic loaders, and the like therefore the briquette must have adequate crush strength to avoid degradation of the briquette.

Furthermore, the resin-polymer liquid binder described herein results in a briquette that may be stored in unconditioned spaces and/or outside and/or may be able to withstand the elements. The resin-polymer liquid binder described herein, and agglomeration process herein may utilize minimal energy and does not require any induration to cure the briquette. The curing time for briquettes described here may be about eight (8) hours to about twenty-four (24) hours for the briquette to be fully cured. However, the briquettes described herein may be handled (e.g., with a front-end loader) and stacked in a storage container after about one hour of cure time.

Referring now to FIG. 1, a method 100 of making a liquid binder for use in the agglomeration process is described. Generally, at block 102, the polyvinyl alcohol (PVOH) is produced. More specifically, the polyvinyl alcohol (PVOH) is produced using a high temperature, high shear, mixing tank where a high temperature of 208 F is reached. At block 104, a sodium hydroxide resole resin is blended with the PVOH containing material about 0.025% to about 30% solid content forming a polyvinyl alcohol (PVOH) resin. This polyvinyl alcohol (PVOH) resin mixture is then brought to a temperature above about 208 F until the polyvinyl alcohol (PVOH) resin is blended into a polymer. At optional block 106, once the polyvinyl alcohol (PVOH) resin mixture is cooled a microbicidal (e.g., a bactericidal), or any other type of anti-microbial product may optionally be added. The anti-microbial or microbicidal product may be added once the temperature is reduced to about 120 F or lower. Some non-limiting examples of antimicrobial compounds may include one or more quaternary ammonium compounds, triclosan, or the like. The anti-microbial may, when utilized, comprise about 0.1% to about 5.0% of the binder. The anti-microbial may be added along with, optionally at block 108, an ester based hardener to advance curing of the briquette. Ester-based hardeners are a type of chemical compound that may be used to improve properties of certain materials, such as concrete or epoxy resins. Adding an ester based hardener may increase the strength, durability and chemical resistance of the material. Examples of ester based hardener include, but are not limited to, an acrylic polymer hardener, a lithium silicate hardener, a potassium silicate hardener, a sodium silicate hardener, epoxy resins, and/or any combination thereof. Generally, there are three stages to an ester based hardening system: 1) an induction period; 2) an exothermic reaction, and 3) gelation and cure. Any ester based hardener, when utilized herein, may comprise about 0.05% to about 5.0% of the binder.

At block 110, a liquid binder solution is prepared by slowly adding about 0.025% to about 30% of a polyvinyl alcohol (PVOH) resin is slowly added to water, which may make up about 0.01% to about 99% of the mixture. Slowly adding the PVOH resin to the water avoids the formation of lumps. The PVOH resin may be sticky as it is mixed, and this tendency may increase as the temperature increases. In some instances, cold water or water with a temperate less than that of the ambient temperature may be used to reduce the risk of the mixture becoming sticky and lumpy. Once the PVOH resin is completely dispersed into the water via high shear mixing to achieve proper disbursement, at block 112, the mixture may be heated to a temperature at which the PVOH resin becomes solubilized, which may range from about 150° F. to about 208° F., depending on the grade of PVOH utilized.

The mixing continues at between about 150° F. to about 208° F., until the PVOH is fully solubilized. The length of time mixing may depend on the grade of material and efficiency of the agitation system. For example, mixing may be required for about 1 hour to about 24 hours; however, this is merely exemplary and not to be understood as limiting.

At block 114, a sodium hydroxide and diethanolamine phenolic resin is then added at an about 1% to about 20% dose to form the liquid binder solution. The sodium hydroxide and diethanolamine phenolic resin used may be diluted at a rate of about 40 g to about 50 g of water to 1 g of phenolic resin before clouding or becoming insoluble. The sodium hydroxide and diethanolamine phenolic resin used may have a temperature resistance between about 800 C to about 3,500 C. Accordingly, the sodium hydroxide and diethanolamine phenolic resol resin may act as an additional binder and may further increase the briquette melting temperature (in the furnace) to up to 3,500 C.

Figure 2:
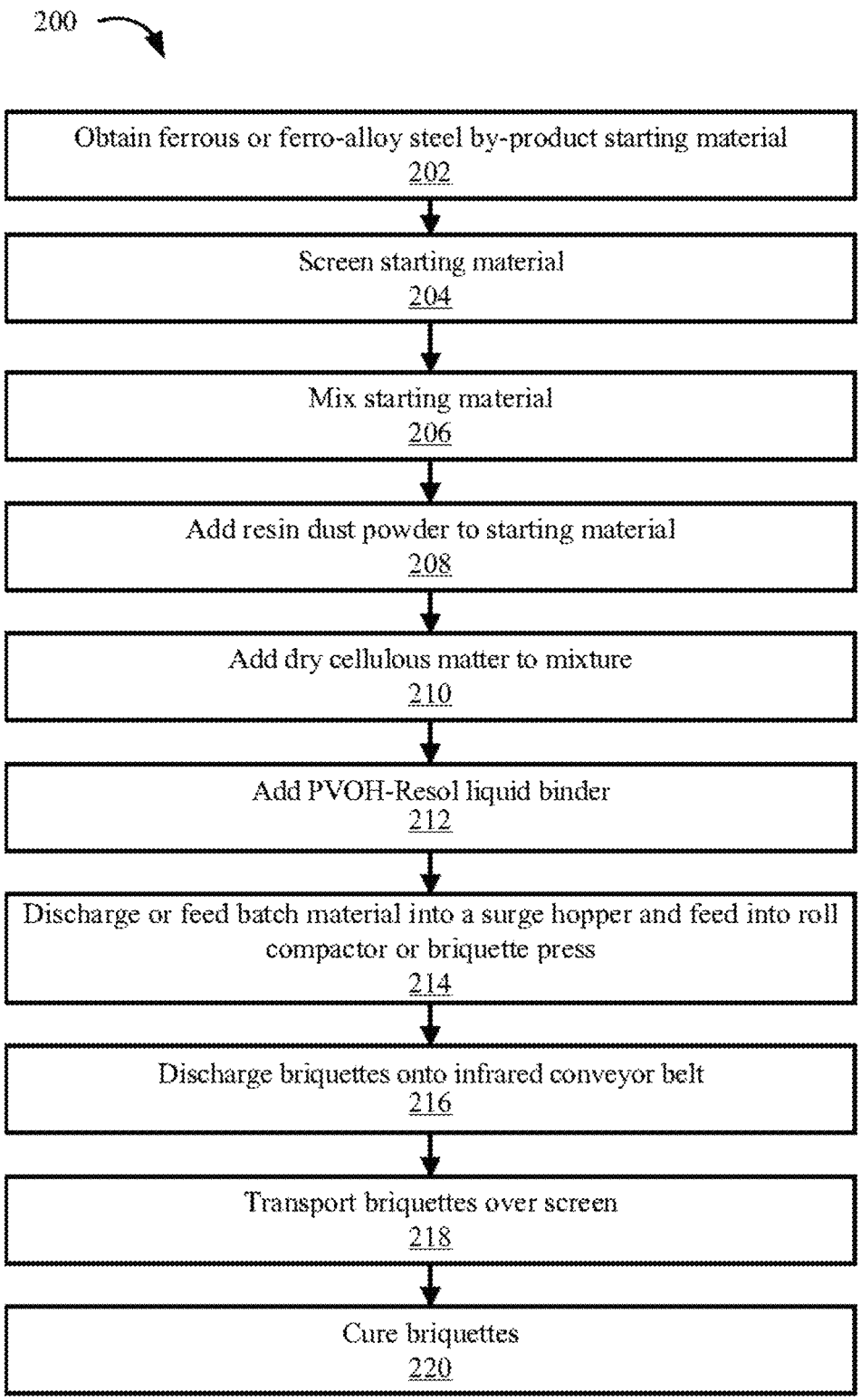
FIG. 2 is an operational flowchart of the production of a briquette consistent with some embodiments of the invention.

An exemplary process for the formation of a briquette utilizing the liquid binder solution described herein is also provided. An operational flowchart 200 for this process is illustrated in FIG. 2. In block 202, the starting material, which may be filings, chips, clippings, dust, fines, bag house dust, sludge, spent shot, laser dust, mill scale, titanium fines, ferro molybdenum, nickel, chrome, and so on is sized to about 8 mm or less particle size. At block 204, the starting material (regardless of form) is screened to remove any oversized material. At block 206, the material is loaded into a mixer (for example a high shear mixer) and mixed at 1 rpm to 100 rpm. At block 208, a resin dust powder may be added to the mixture at a rate of about 0.01 to about 10.0% of batch weight. A non-limiting example of a suitable resin dust powder may be a powdered phenolic novolac with hexamethylenetetramine, although this is not to be understood as limiting. The phenolic resin may be beneficial for achieving a higher melt temperature (for the resulting briquettes when placed in the furnace), and may also further create a water-resistant barrier, which may allow for outdoor and/or unconditioned briquette storage.

At block 210 a plurality of dry cellulous matter may be added at a rate of about 0.005% to about 5.0% of batch weight. This dry cellulose fiber may function as a fiber connector, increasing the tensile strength of the resulting briquette and providing reinforcement to the resulting briquettes.

At block 212, the liquid binder solution described above (e.g., the PVOH-resin binder solution) may be added at a rate of about 0.025% to about 10% of the batch weight. All material may be continuously mixed in a continuous mixer for about 30 seconds to about 10 hours. The liquid PVOH may be utilized as a polymer for binding the material. The phenolic resin is a co-polymer that may act as a cross link between the material and the PVOH polymer.

Once mixed, at block 214, the batch material may be discharged or fed into a surge hopper. The batch material may then be screw fed into a roll compactor or briquette press machine in order to form the briquettes (see FIG. 3). Briquettes may take any suitable form. For example, briquettes may be cuboid in shape, spherical in shape, cylindrical in shape, rectangular prism shaped, pyramid in shape, rectangular tetrahedral shaped, cone shaped, triangular prism shaped, and/or any other three-four dimensional shape desired.

At block 216, the briquettes, regardless of their shape, may be discharged from the roll compactor onto an infrared conveyor belt where the temperature increases to about 150 F for a period of about two to about five minutes. At block 218, the briquettes, regardless of shape may be transported over a screen (for example a ¼ inch, ⅜ inch, ⅝ inch, or the like screen) in order to remove any remaining flashing, fines, or dust from the briquette. At block 220 the briquettes may then be transported to a storage area for curing. As stated previously, the curing time briquettes produced as described herein may be up to about eight (8) hours or up to about twenty-four (24) hours for complete curing and being ready for transport; however, the briquettes may be handled, for example with a front-end loader, after only about one (1) hour of curing time, which may allow the briquettes to be stacked in a storage facility. Once cured and in final form, the resulting briquettes may include only about 0.05% to about 10.0% binder content in the briquette, as the majority of the binder is burned off during the briquette production process. The briquette resulting from the process described herein may have a green strength of about 80 psi to about 300 psi Cold Crush Strength (CCS) and an adequate cured crush strength of about 300 psi to about 1,500 psi.

Figure 3:
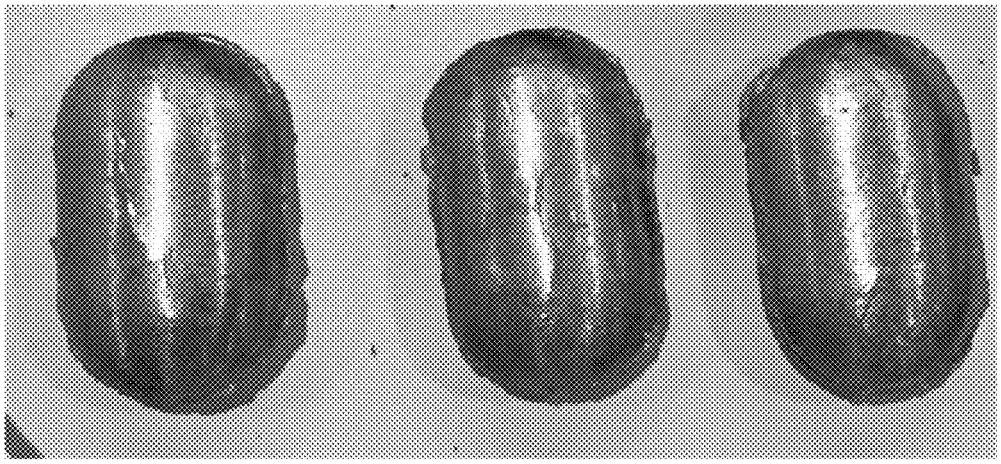
FIG. 3 is an image depicting a briquette resulting from the method described herein.

FIG. 3 is an image depicting an exemplary briquette 300 produced utilizing the liquid binder and method described herein. As mentioned previously herein, the briquette may be any shape or size. The shape and size of the resulting briquette may be determined by the machinery and/or mold utilized during the formation of the briquettes.

Table 1 presented herein, represents testing conducted of briquettes produced according to the method described herein. As shown in the table, various samples of briquettes with varying cure times and CCS measurements were tested. It is clear from the table that a longer cure time may result in a larger CCS measurement.

TABLE 1

| Briquette | Cure Time | CCS Measurement |
|---|---|---|
| Sample 1 | 1 minute | 80 psi |
| Sample 2 | 30 minutes | 160 psi |
| Sample 3 | 60 minutes | 340 psi |
| Sample 4 | 12 hours | 550 psi |
| Sample 5 | 24 hours | 1100+ psi |

Binders, including embodiments described herein, may be burned off during the steel production process, for example at temperatures ranging between about 800 C and about 3,500 C. For example, as a part of the steel making process the briquettes are placed in a blast furnace or electric arc furnace; when heat is applied, the briquette melts and the binder residue burns off in the form of vapor exhaust.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A briquette, the briquette comprising:
- a ferrous or ferro-alloy steel by-product;
- a binder mixture, wherein the briquette is formed from an uncured batch material comprising about 0.025% to about 10% by weight of the binder mixture, wherein the binder mixture comprises—
  - about 0.025% to about 30% of a polyvinyl alcohol resin,
  - about 1% to about 20% of a phenolic resin,
  - about 0.05% to about 5.0% of an ester-based hardener, and
  - water forming a remainder of the binder mixture;
- a resin powder, wherein the uncured batch material comprises about 0.01% to about 10% by weight of the resin powder; and
- wherein the briquette, when cured, contains about 0.05% to about 10% of the binder mixture.

2. The briquette of claim 1, wherein the resin powder is a powdered phenolic novolac with hexamethylenetetramine.

3. The briquette of claim 1, wherein the briquette further comprises a dry cellulous matter, wherein the uncured batch material comprises about 0.005% to about 5.0% by weight of the dry cellulous matter.

4. The briquette of claim 1, wherein the briquette has a Cold Crush Strength (CCS) of about 80 to about 300 psi.

5. The briquette of claim 1, wherein the briquette, when cured, has a cured crush strength of about 300 psi to about 1,500 psi.

6. The briquette of claim 1, wherein the briquette requires about 8 to about 24 hours to cure.

7. The briquette of claim 1, wherein the binder mixture further includes a microbicidal, wherein the binder mixture comprises about 0.1% to about 5.0% of the microbicidal.

8. A binder for use in the formation of briquettes from ferrous or ferro-alloy steel byproducts, the binder comprising:

about 0.025% to about 30% of a polyvinyl alcohol resin;

about 1% to about 20% of a phenolic resin;

about 0.05% to about 5.0% of an ester-based hardener; and water forming a remainder of the binder.

9. The binder for use in the formation of briquettes from ferrous or ferro-alloy steel byproducts of claim 8, wherein the binder further includes about 0.1% to about 5.0% of a microbicidal.

10. The briquette of claim 1, wherein the binder mixture further comprises sodium hydroxide.

11. The briquette of claim 1, wherein the binder mixture further comprises diethanolamine.

12. The binder for use in the formation of briquettes from ferrous or ferro-alloy steel byproducts of claim 8, wherein the binder further comprises sodium hydroxide.

13. The binder for use in the formation of briquettes from ferrous or ferro-alloy steel byproducts of claim 8, wherein the binder further comprises diethanolamine.

* * * * *